US007537440B2

(12) United States Patent
Goodwin et al.

(10) Patent No.: US 7,537,440 B2
(45) Date of Patent: May 26, 2009

(54) SCROLL COMPRESSOR WITH MULTIPLE ISOLATED INLET PORTS

(75) Inventors: David John Goodwin, Crawley (GB); Alan John Saunders, Angmering (GB); Philip Lawrence May, Dorking (GB); Graeme Huntley, Bridgwater (GB)

(73) Assignee: Edwards Limited, Crawley, West Sussex (GB)

( * ) Notice: Subject to any disclaimer, the term of this patent is extended or adjusted under 35 U.S.C. 154(b) by 0 days.

(21) Appl. No.: 10/567,806

(22) PCT Filed: Aug. 10, 2004

(86) PCT No.: PCT/GB2004/003429

§ 371 (c)(1),
(2), (4) Date: Feb. 8, 2006

(87) PCT Pub. No.: WO2005/019651

PCT Pub. Date: Mar. 3, 2005

(65) Prior Publication Data

US 2006/0228244 A1 Oct. 12, 2006

(30) Foreign Application Priority Data

Aug. 19, 2003 (GB) ..... 0319513.8

(51) Int. Cl.
*F03C 2/00* (2006.01)
*F04C 2/00* (2006.01)

(52) U.S. Cl. ..... 418/15; 418/55.1; 418/55.2; 417/202; 417/205

(58) Field of Classification Search ..... 418/15, 418/55.1–55.6, 57, 5–8, 58, 61.1, 209; 417/202, 417/205, 250

See application file for complete search history.

(56) References Cited

U.S. PATENT DOCUMENTS 4,141,677 A 2/1979 Weaver et al.

(Continued)

FOREIGN PATENT DOCUMENTS

EP 0 679 810 A2 11/1995

(Continued)

OTHER PUBLICATIONS

Patent Abstracts of Japan, Hitachi Ltd, abstract of JP61258989 A entitled Scroll Fluid Machine, Nov. 17, 1986.

(Continued)

*Primary Examiner*—Theresa Trieu
(74) *Attorney, Agent, or Firm*—Ira Lee Zebrak

(57) ABSTRACT

A scroll compressor having a scroll wall arrangement with a fixed scroll having fixed scroll walls and an orbiting scroll having orbiting scroll wall, an inlet at a radially outer portion and an outlet at a radially central portion, a first flow path defined by the orbiting and fixed scroll walls and extending from the inlet to the outlet, gas entering through inlet at a pressure and exhausting through outlet at a second pressure higher than the first pressure. Scroll wall arrangement having a second inlet through which gas enters at a third pressure and follows a second fluid path where it is exhausted through the outlet at the second pressure to form two flow paths having respective inlets. The third pressure at which gas enters through inlet is different from the first pressure, and lower than the second pressure.

14 Claims, 14 Drawing Sheets

U.S. PATENT DOCUMENTS

| | | | | | |
|---|---|---|---|---|---|
| 4,157,234 | A | * | 6/1979 | Weaver et al. | 418/55.2 |
| 4,475,360 | A | * | 10/1984 | Suefuji et al. | 418/55.1 |
| 4,696,627 | A | | 9/1987 | Asano et al. | |
| 4,735,084 | A | | 4/1988 | Fruzzetti | |
| 4,919,599 | A | | 4/1990 | Reich et al. | |
| 5,103,652 | A | | 4/1992 | Mizuno et al. | |
| 5,228,838 | A | | 7/1993 | Gebele et al. | |
| 5,733,104 | A | * | 3/1998 | Conrad et al. | 417/250 |
| 6,116,875 | A | | 9/2000 | Kolb et al. | |
| 2003/0059327 | A1 | | 3/2003 | Fujioka et al. | |

FOREIGN PATENT DOCUMENTS

| | | | | | |
|---|---|---|---|---|---|
| EP | 0 863 313 | A1 | | 9/1998 | |
| GB | 2 358 438 | A | | 7/2001 | |
| JP | 61258989 | A | * | 11/1986 | 418/15 |

OTHER PUBLICATIONS

United Kingdom Search Report of Application No. GB0319513.8; Date of Search: Jan. 19, 2004.

PCT International Search Report of International Application No. PCT/GB2004/003429; Date of mailing of International Search Report: Oct. 28, 2004.

PCT Written Opinion of the International Searching Authority of International Application No. PCT/GB2004/003429; Date of mailing: Oct. 28, 2004.

* cited by examiner

SCROLL COMPRESSOR WITH MULTIPLE ISOLATED INLET PORTS

FIELD OF THE INVENTION

The present invention relates to an improved scroll compressor, and scroll wall arrangement therefor.

BACKGROUND OF THE INVENTION

A typical scroll compressor is shown in FIGS. 1 and 2. FIG. 1 is a cross-section of a scroll compressor 10, which comprises a fixed scroll 12 and an orbiting scroll 14. The fixed scroll comprises a generally planar disc 16 from which a scroll wall 18 extends perpendicularly. The orbiting scroll comprises a generally planar disc 20 from which a scroll wall 22 extends perpendicularly. A motor 24 is provided for rotating shaft 26. Shaft 26 has an eccentric shaft portion 28 fixed to the orbiting scroll 14. The eccentric motion of shaft portion 28 causes an orbiting motion of the orbiting scroll wall 22 relative to the fixed scroll wall 18. This relative motion causes fluid to be pumped from an inlet 30 provided at an outer radial portion of the scroll wall arrangement to an outlet, or exhaust, 32 provided at a radially central portion of the scroll wall arrangement. Gas enters the compressor through a compressor inlet (not shown).

FIG. 2 is a cross-section of the scroll wall arrangement of the scroll compressor taken along line II-II in FIG. 1. A fluid flow path 34 is shown in FIG. 2 by the arrowed line and follows a generally spiral path from the inlet 30 to the outlet 32 of the scroll wall arrangement. Gas enters through inlet 30 at a first pressure, is compressed over the course of four revolutions or wraps and is exhausted from the pump through outlet 32 at a higher pressure. The number of wraps can be more or less than shown in FIG. 2 and is selected depending on the pumping requirements. The relative orbiting motion of the scroll walls causes a plurality of crescent shaped pockets to be formed between the walls and forced radially inwardly, gradually being compressed in size. As is known to the skilled person, the extent of these crescent shaped pockets is approximately 360 degrees and the extent of the walls trapping a crescent shaped pocket is known as a wrap.

A scroll compressor is useful in that it is a lubricant free pump. Thus, a scroll compressor can often be adopted in mass spectrometer systems. A mass spectrometer system may include a differentially pumped series of chambers in which a plurality of chambers are pumped to different pressures and have respective interconnections between the chambers. The first chamber may be kept at a relatively high pressure (e.g. 2 to 10 mbar), with the last chamber being kept at a relatively lower pressure (e.g. $10^{-5}$ mbar). Typically, the low pressure chamber or chambers are pumped by a turbomolecular pump and the relatively higher pressure chamber or chambers are pumped by a primary pump. A scroll compressor is a suitable type of primary pump. As is known in the art, a turbomolecular pump requires a backing pump so that gas exhausted from the turbomolecular pump at a pressure less than atmosphere is pumped by a backing pump and exhausted at atmosphere. Such a differentially pumped system can therefore require at least three pumps: a turbomolecular pump, a backing pump and a pump for the relatively higher pressure chamber.

There is a desire to provide an improved pumping solution for the above mentioned problem and to provide a more versatile scroll compressor for pumping applications generally.

BRIEF SUMMARY OF THE INVENTION

The present invention provides scroll wall arrangement for a scroll compressor, the arrangement comprising a fixed scroll wall and an orbiting scroll wall, which together define a plurality of flow paths having respective inlets for simultaneous pumping at different pressures, wherein the plurality of flow paths comprise a first flow path extending from a first inlet to an outlet and a second flow path extending from a second inlet to the outlet, and wherein the second inlet is isolated from the first flow path.

The present invention also provides a scroll compressor comprising a scroll wall arrangement as aforementioned.

The present invention further provides a differentially pumped system comprising: a series of chambers having respective interconnections therebetween; a turbomolecular pump having an inlet connected to one said chamber for pumping at relatively low pressures; and a scroll compressor as aforementioned, wherein one inlet of the scroll compressor is connected to another of the chambers for pumping at relatively high pressures and another inlet of the scroll compressor is connected to the exhaust of the turbomolecular pump for backing same.

Other preferred aspects of the invention are defined in the accompanying claims.

BRIEF DESCRIPTION OF THE DRAWINGS

In order that the present invention may be well understood, various embodiments thereof, which are given by way of example only, will now be described with reference to the accompanying drawings, in which.

DETAILED DESCRIPTION OF THE INVENTION

Figure 1:
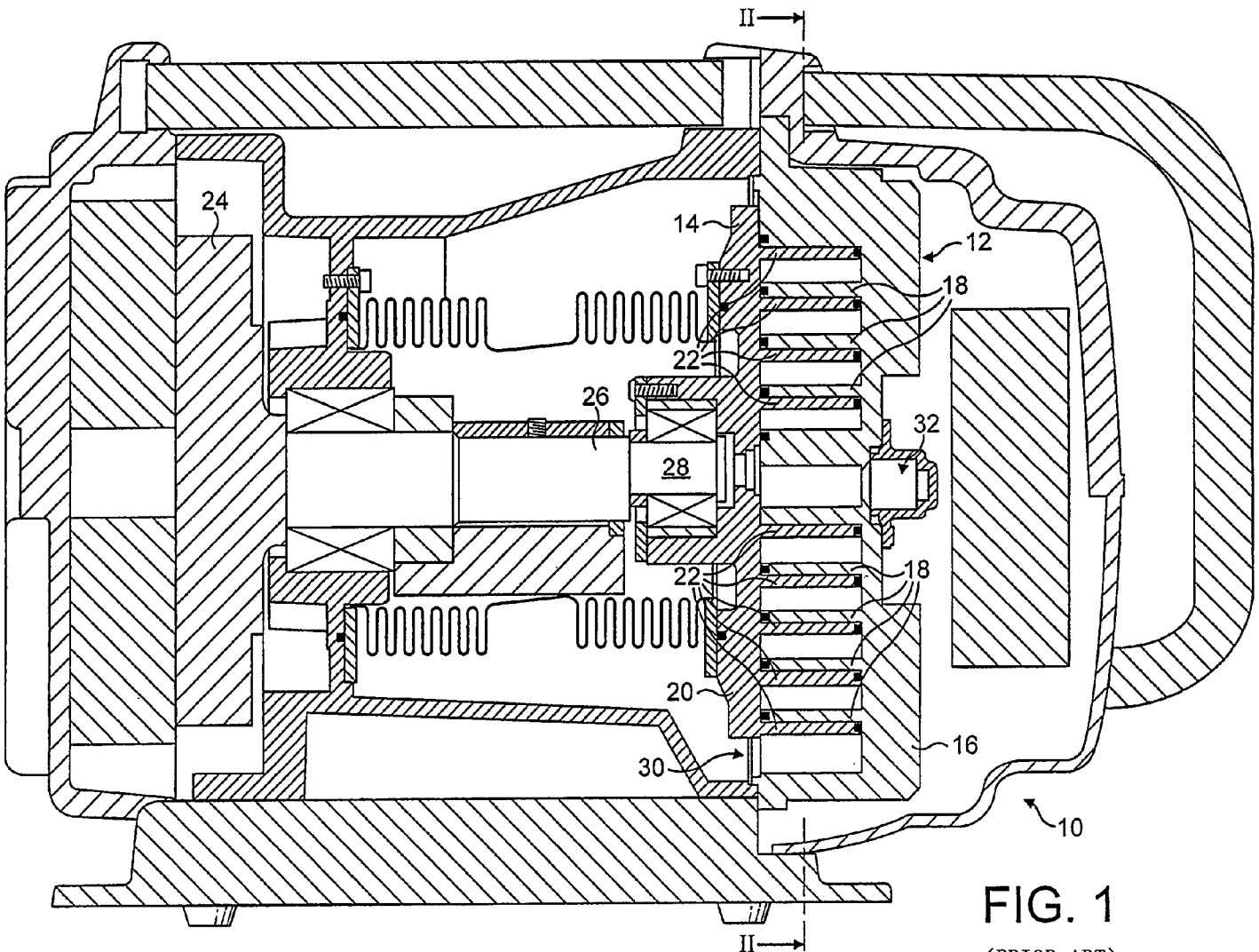
FIG. 1 (PRIOR ART)
FIG. 1 is a cross section of a prior art scroll compressor.

The scroll wall arrangements shown in FIGS. 3 to 8 have the same general layout as the scroll compressor shown in FIG. 1 and differ therefrom in the scroll wall arrangement. Accordingly, the general operation of a scroll compressor will not be described again, and these arrangements will be described with reference to the scroll wall arrangement.

Figure 2:
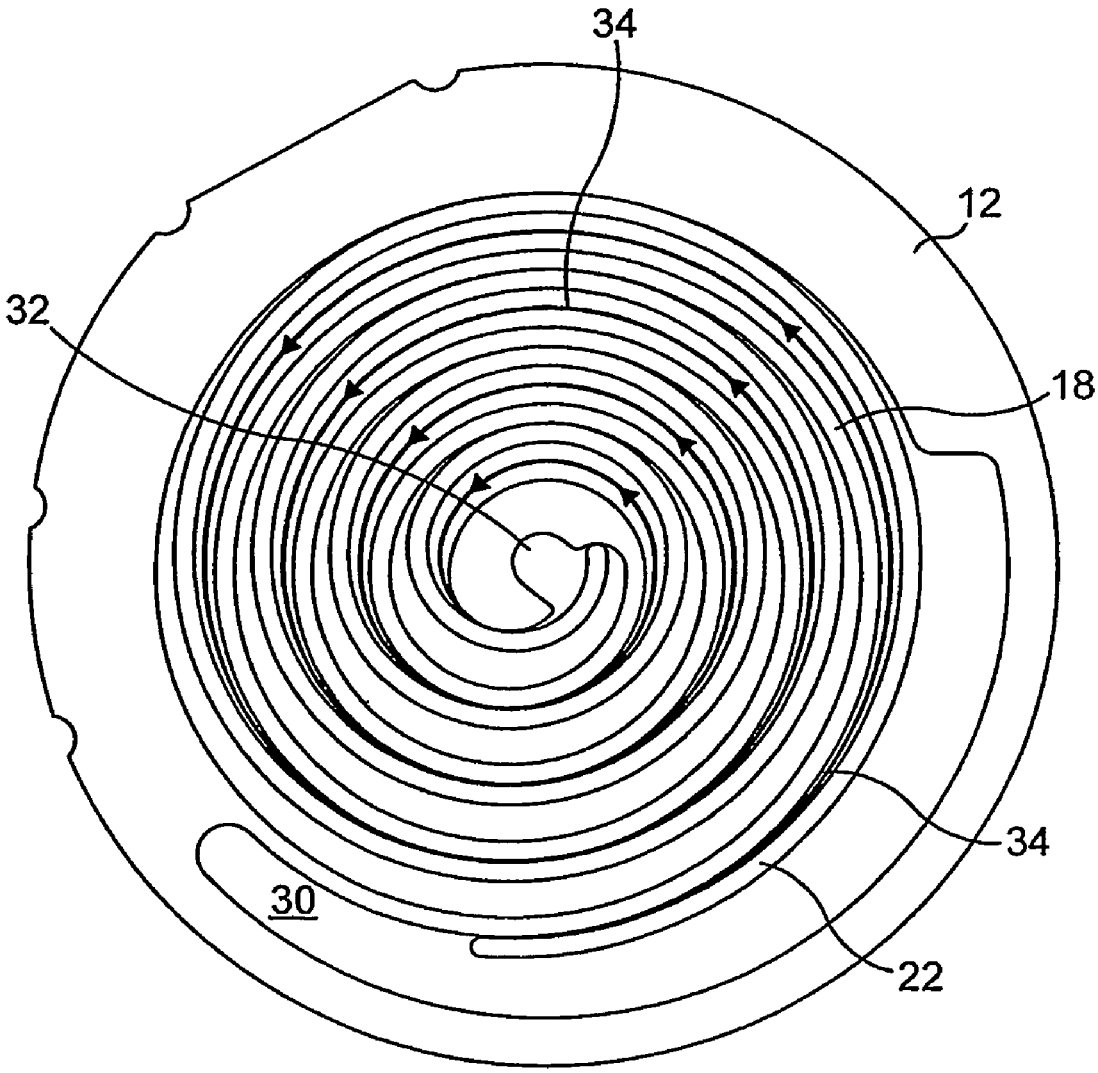
FIG. 2 (PRIOR ART)
FIG. 2 is a cross-section of a scroll wall arrangement of the compressor in FIG. 1 taken along line II-II.
Figure 3:
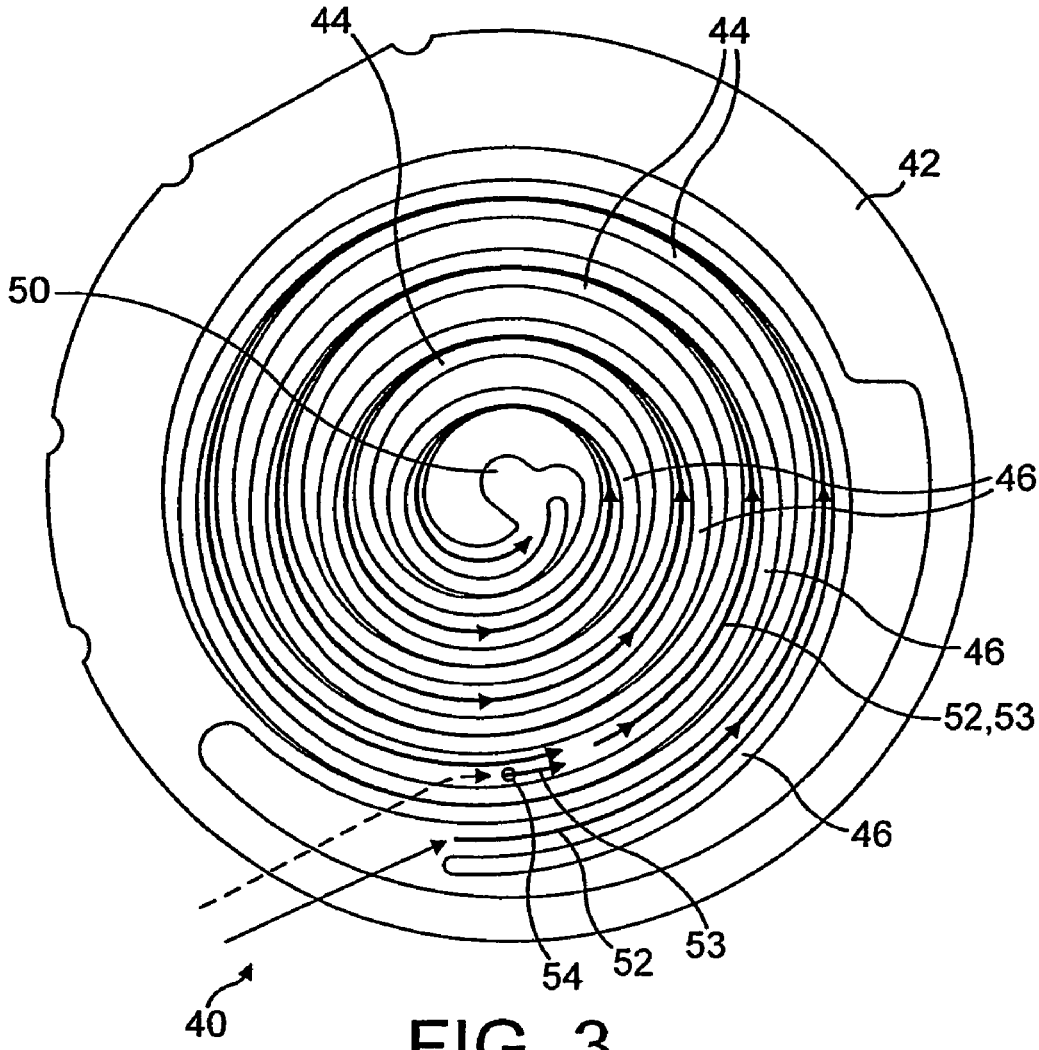
FIG. 3 shows a cross-section of a scroll wall arrangement.

Referring to FIG. 3, a scroll wall arrangement 40 is shown, which comprises a fixed scroll 42 having fixed scroll walls 44 and an orbiting scroll having orbiting scroll walls 46. In the same way as the scroll wall arrangement shown in FIG. 2, scroll arrangement 40 has an inlet 48 at a radially outer portion thereof and an outlet 50 at a radially central portion thereof. A first flow path 52 is defined by the orbiting and fixed scroll walls 44, 46 and extends from the inlet 48 to the outlet 50, gas entering the arrangement through inlet 48 at a first pressure and exhausting through outlet 50 at a second pressure higher than the first pressure. Scroll wall arrangement 40 comprises a second inlet 54 through which gas can enter at a third pressure and follow a second fluid path 53 where it is exhausted through outlet 50 at the second pressure. Two flow paths 52, 53 are provided having respective inlets 48 and 54, although, the first flow path 52 is merged with the second flow path 53 over the entire extent of the second flow path. The third pressure at which gas enters through inlet 54 is higher than the first pressure and lower than the second pressure. Accordingly, inlets 48 and 54 can pump gas at different pressures. The positioning of the second inlet 54 determines the third pressure at which gas enters through the second inlet (i.e. the closer the inlet is positioned to the exhaust the higher the third pressure).

The scroll arrangement 40 allows, for example, a differentially pumped system of two interconnected chambers to be held at different pressures whilst being pumped by a single scroll compressor. Hence, there is a cost saving in that only one pump is required.

The invention, therefore, allows a single scroll compressor simultaneously to pump two chambers at different pressures. For example, the compressor may be used to evacuate a load lock chamber with a coating system. Also, such a scroll compressor could be used to back a turbomolecular pump whilst also to evacuate a relatively higher pressure chamber. Such a scroll compressor has numerous other pumping advantages and applications.

Figure 12:
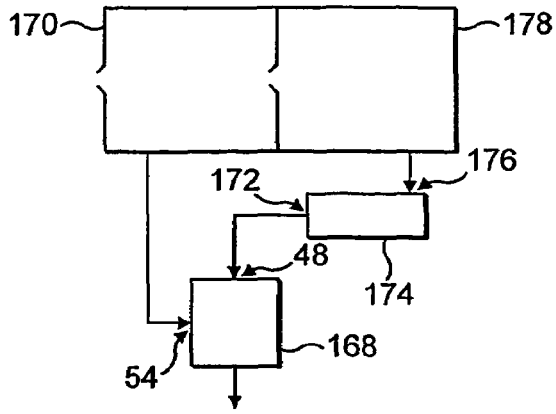
FIG. 12 is a system diagram of a first differentially pumped system.

In a differentially pumped system as shown in FIG. 12, a scroll compressor 168 comprising scroll wall arrangement 40 is arranged with the second inlet 54 placed in fluid communication with a first chamber 170 for pumping at a first pressure and first inlet 48 placed in fluid communication with the exhaust 172 of a turbomolecular pump 174 for backing the same. The inlet 176 of the turbomolecular pump is connected to a second chamber 178 for pumping at a relatively low pressure. Accordingly, in a differentially pumped system comprising a turbomolecular pump, a single pump is required in place of the primary and backing pumps required according to the prior art.

Figure 13:
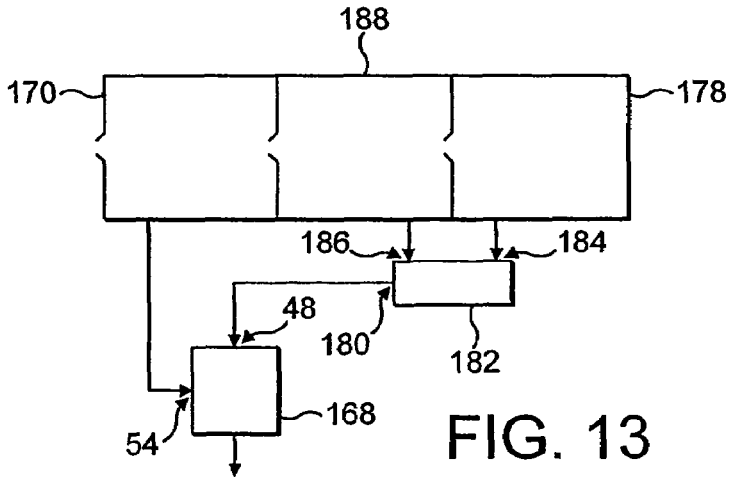
FIG. 13 is a system diagram of a second differentially pumped system.

A second differentially pumped system is shown in FIG. 13, in which second inlet 54 of scroll compressor 168 is connected to a first chamber 170, and first inlet 48 is connected to the exhaust 180 of a split flow turbomolecular pump 182. A main inlet 184 of the turbomolecular pump 182 is connected to one chamber 178, and a second, inter-stage, inlet 186 is connected to another chamber 188.

Figure 14:
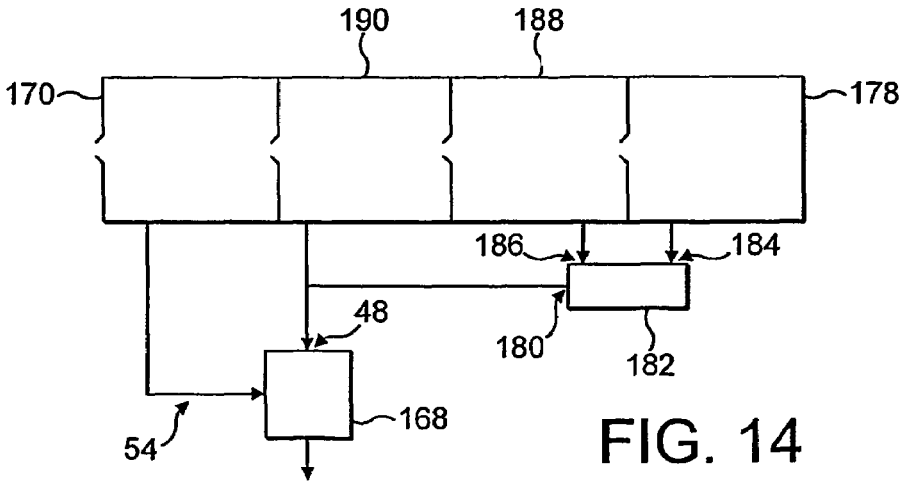
FIG. 14 is a system diagram of a third differentially pumped system.

A third differentially pumped system is shown in FIG. 14, in which second inlet 54 of scroll compressor 168 is connected to a first chamber 170, and first inlet 48 is connected to the exhaust 180 of a split flow turbomolecular pump 182 and a second chamber 190. The connection of the split-flow turbomolecular pump 182 to two interconnected chambers 178, 188 is as shown in FIG. 13.

There follows a description of various further scroll compressor arrangements and any of the arrangements can suitably be incorporated into the differentially pumped systems shown in FIGS. 12 to 14.

Many other advantages and applications of the arrangements will be appreciated by the skilled person.

Figure 4:
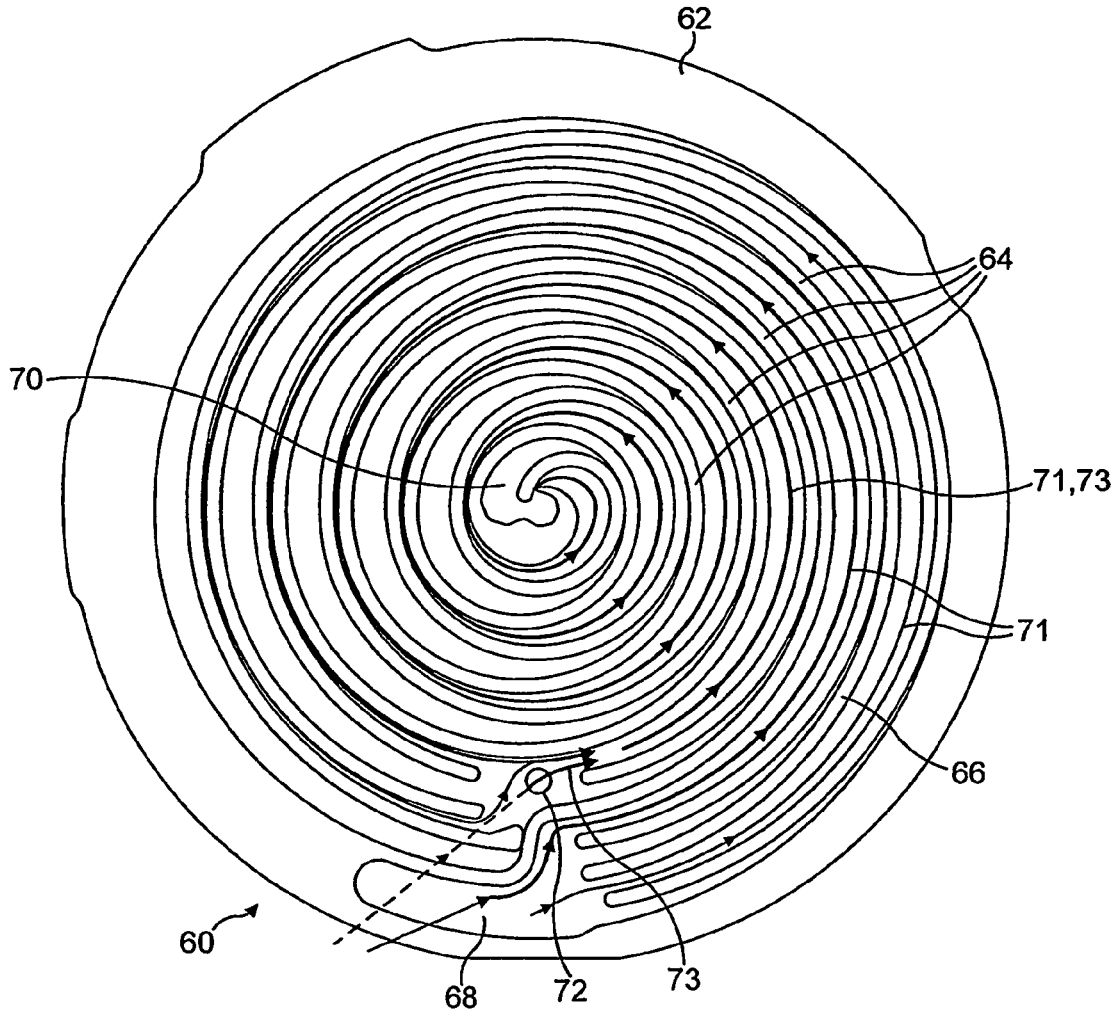
FIG. 4 shows a cross-section of another scroll wall arrangement

A scroll wall arrangement 60 is shown in FIG. 4, and comprises a fixed scroll 62 having fixed scroll walls 64 and an orbiting scroll having orbiting scroll walls 66. The arrangement 60 comprises a first inlet 68, an outlet 70, and a second inlet 72. The arrangement 60 has a double start in that two first flow paths 71 extend from inlet 60 over one revolution, or wrap, after which they converge. The second inlet 72 is provided where the first flow paths 71 converge. A second flow path 73 extends from the second inlet 72 to the outlet 70 and is merged with the first flow path 71 over the extent of the second flow path. The benefit of a double start arrangement as shown in FIG. 4 is an increase in the amount of gas that can be pumped through inlet 68. The arrangement of the scroll arrangement 60 is otherwise the same as that shown in FIG. 3.

It is also possible to provide a scroll wall arrangement wherein a plurality of said first inlets are provided having respective said first flow paths extending therefrom which converge to a single said first flow path. This arrangement provides a plurality of inlets for pumping at a first pressure.

Figure 5A:
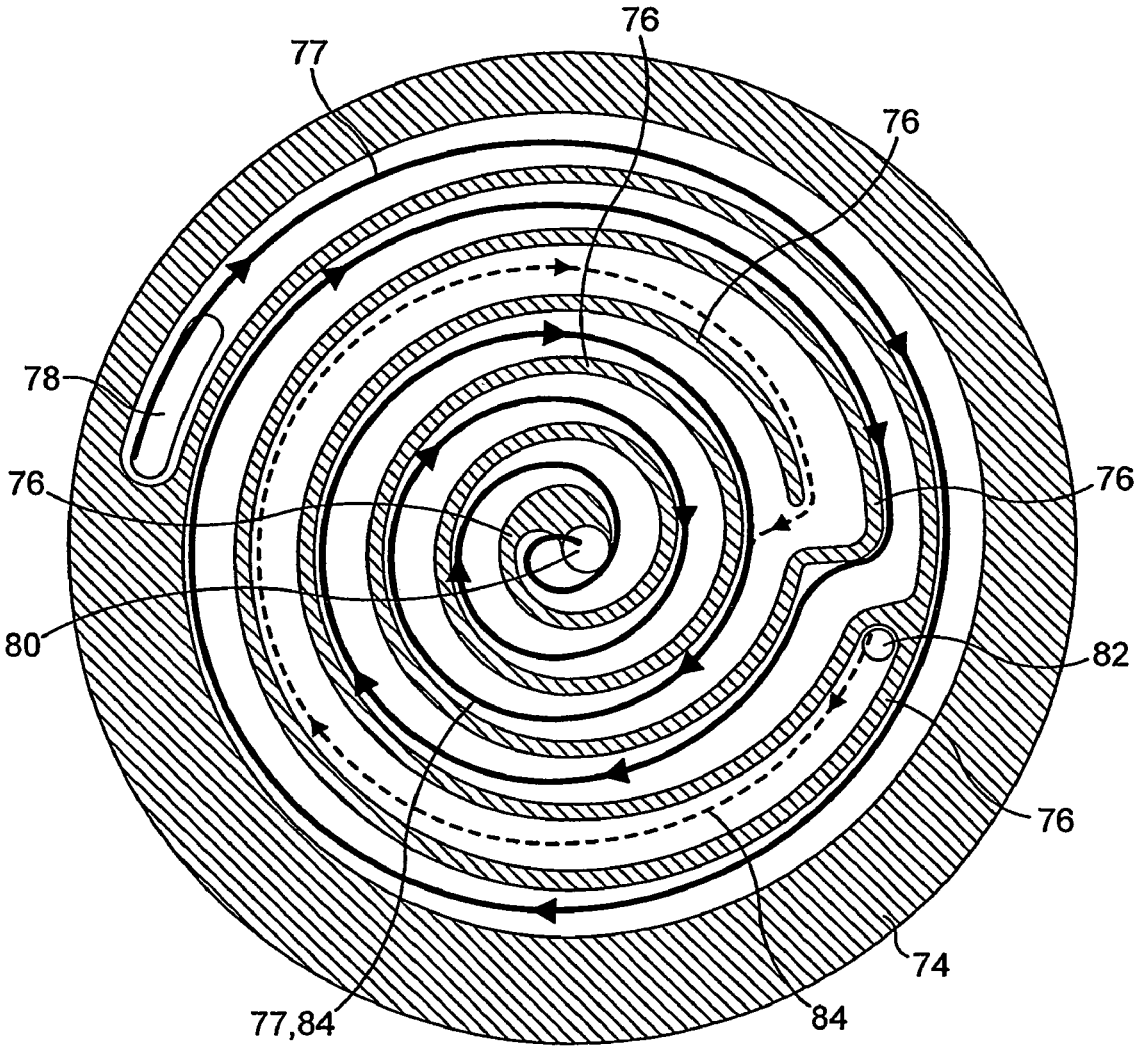
FIG. 5 shows a cross-section of a scroll wall arrangement according to a first embodiment of the present invention, FIG. 5(*a*) showing the fixed scroll wall only and FIG. 5(*b*) showing both the fixed scroll wall and the orbiting scroll wall.
Figure 5B:
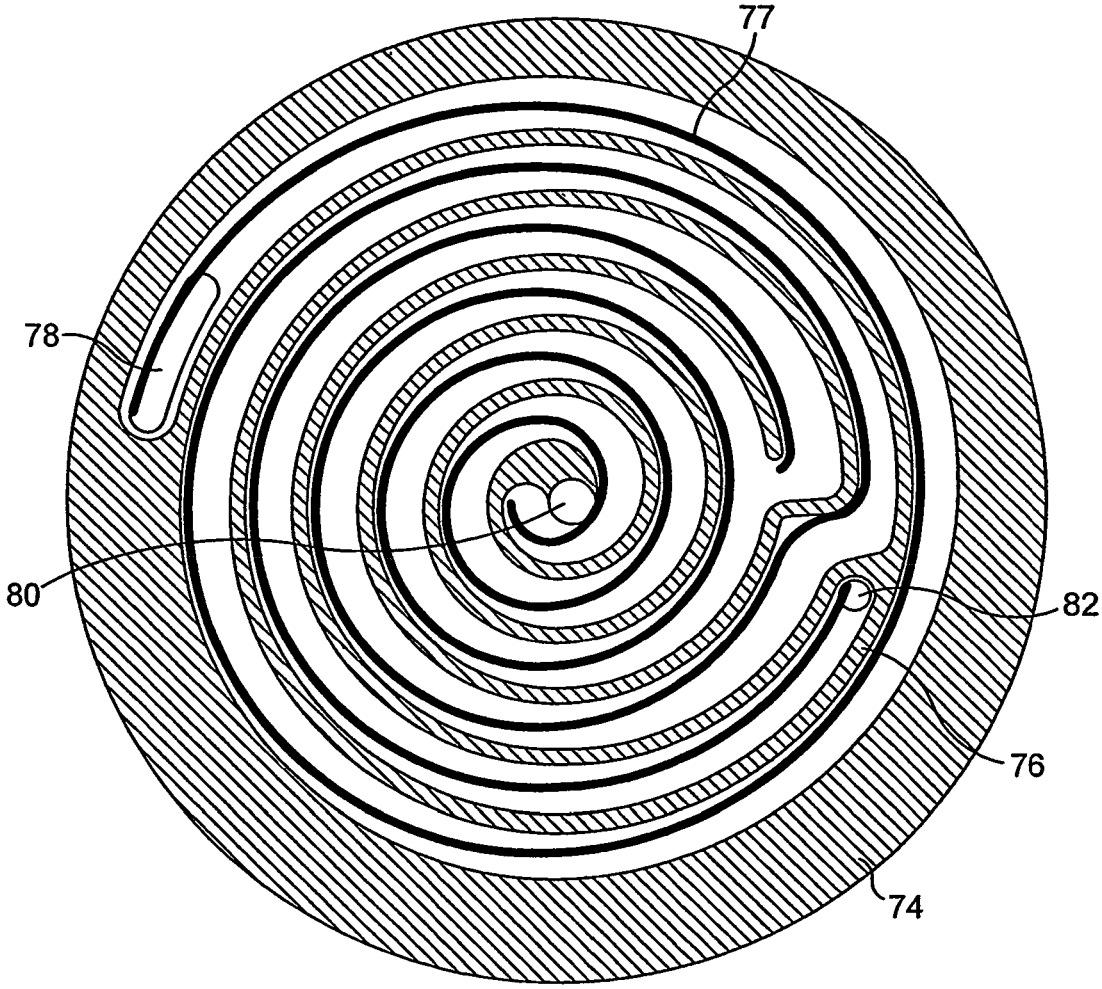

FIGS. 5-8 show four further modifications to the scroll wall arrangement as described in relation to FIG. 3. FIGS. 5(*a*), 6(*a*), 7(*a*) and 8(*a*) show the flow paths and fixed scroll only, with FIGS. 5(*b*), 6(*b*), 7(*b*) and 8(*b*) showing both the fixed scroll and the orbiting scroll.

In the scroll wall arrangement 40 shown in FIG. 3, the second inlet 54 is provided on the first flow path 52 between the first inlet 48 and outlet 50. Accordingly, the pressure at the second inlet 54 has an affect on the pressure at inlet 48. In certain circumstances, it may be desirable to isolate the pressure at the secondary inlet. The fixed scroll wall arrangement shown in FIG. 5 achieves isolation of the secondary inlet. In this regard, FIG. 5(*a*) shows a fixed scroll 74 having fixed scroll walls 76, the orbiting scroll wall 75 being shown in FIG. 5(*b*). A first flow path 77 extends from a first inlet 78 to outlet 80. A second inlet 82 is isolated from the first flow path 77 by approximately one wrap of the fixed scroll. The second flow path 84 extends from the second inlet 82 through approximately 360° where it merges with the first flow path and follows a merged flow path 77, 84 to outlet 80. With the arrangement shown in FIG. 5, it is possible to maintain a pressure at the second inlet independently from the pressure at the first inlet 78. It will be appreciated however that some isolation is achieved provided that the second inlet is isolated from the first flow path by at least a portion of said second flow path (i.e. less than one wrap).

Figure 6A:
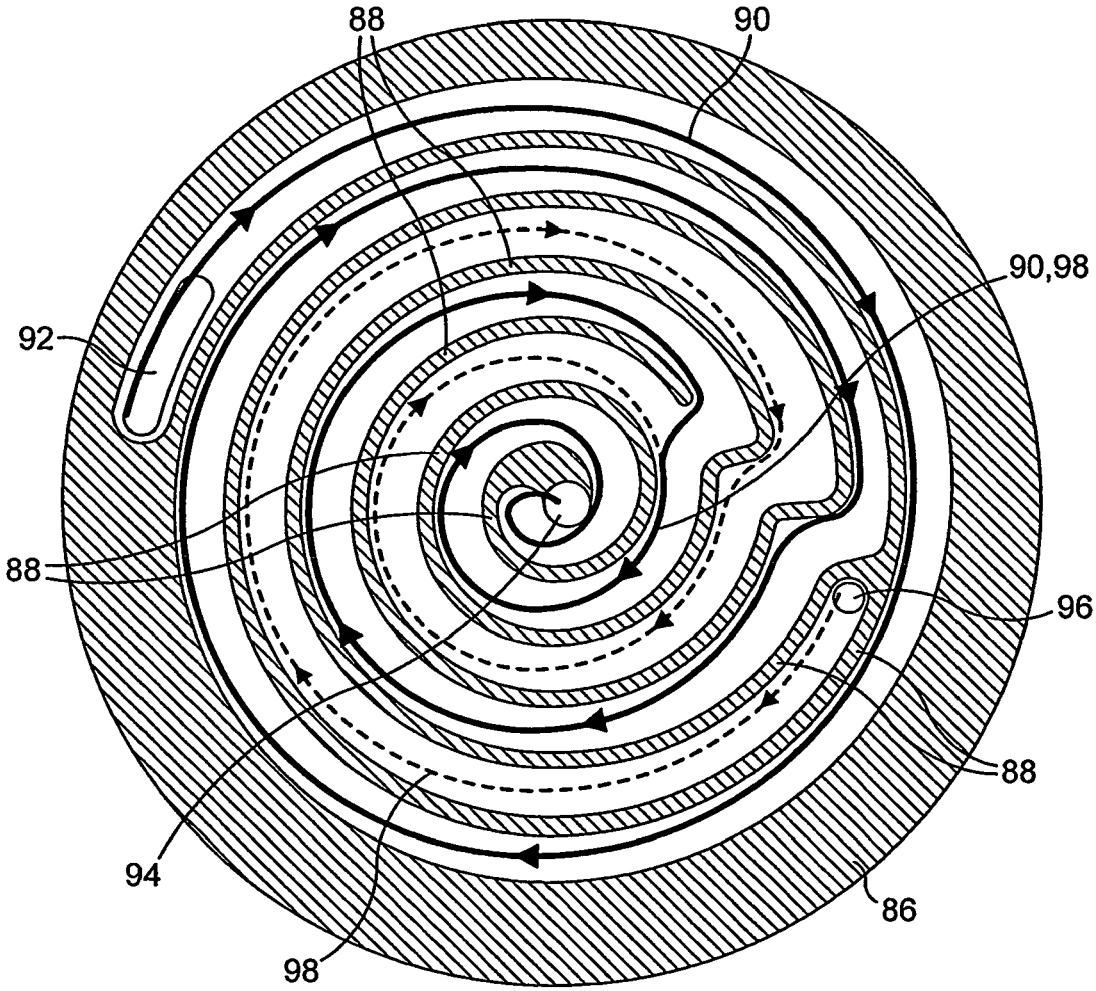
FIG. 6 shows a cross section of a scroll wall arrangement according to a second embodiment of the present invention, FIG. 6(*a*) showing the fixed scroll wall only and FIG. 6(*b*) showing both the fixed scroll wall and the orbiting scroll wall.
Figure 6B:
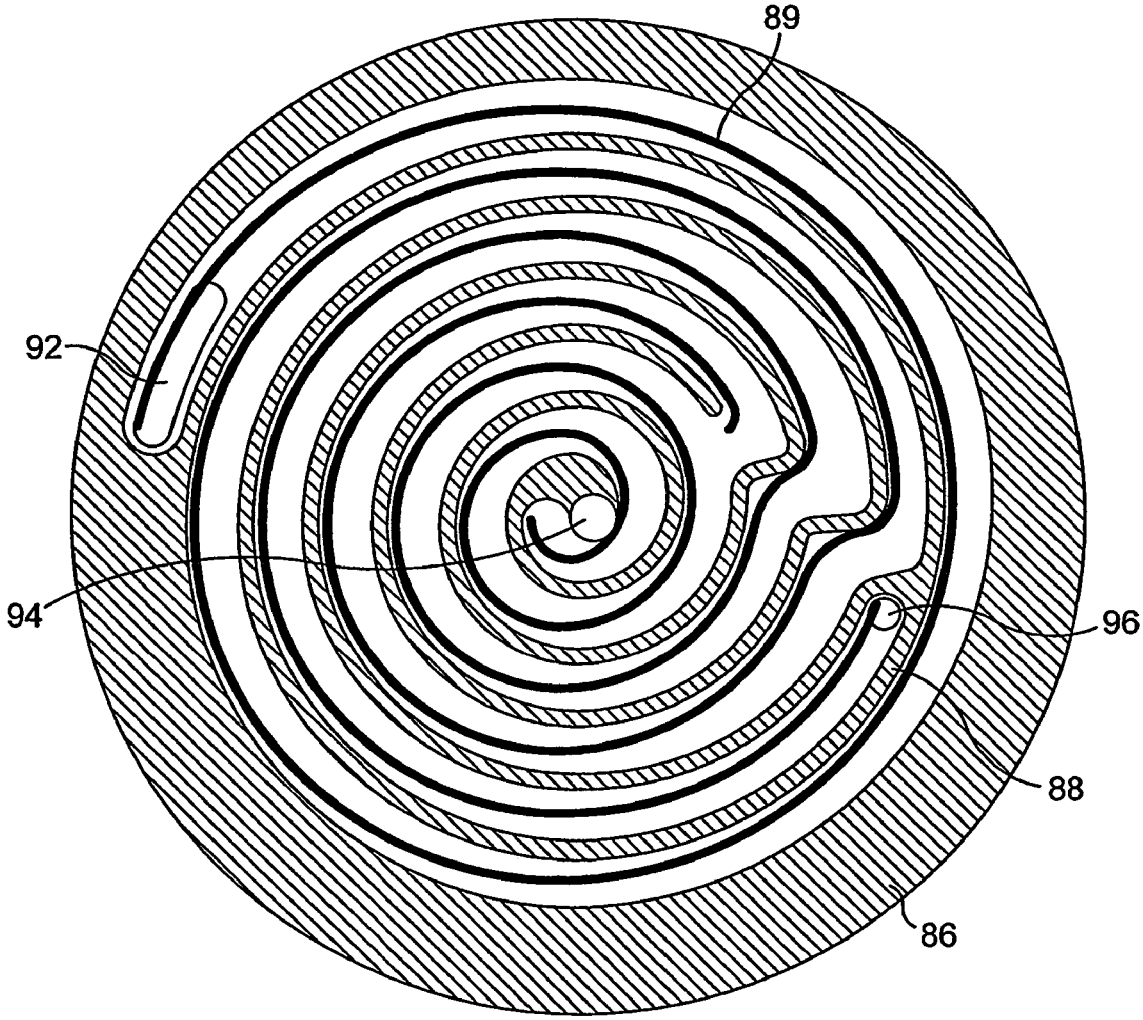

FIG. 6(*a*) shows a fixed scroll 86 having fixed scroll walls 88, the orbiting scroll wall 89 being shown in FIG. 6(*b*). A first flow path 90 extends from a first inlet 92 to the outlet 94. A second inlet 96 is isolated from the first flow path 90 by approximately two wraps of the fixed scroll. A second flow path 98 extends from the second inlet 96 through approximately 700° where it merges with the first flow path 90 and extends to outlet 94. The arrangement shown in FIG. 6 may be advantageous over the arrangement shown in FIG. 5 in that greater isolation of the pressure at the secondary inlet 96 from the first inlet 92 can be achieved, for example, when a greater differential pressure is required.

The arrangement shown in FIGS. 5 and 6 is further advantageous in certain pumping applications where it is preferable to provide some isolation of the gas species being pumped at respective inlets. Consequently, in these arrangements the first inlet and the second inlet can be used interchangeably as required due to the independence of the two inlets.

Figure 7A:
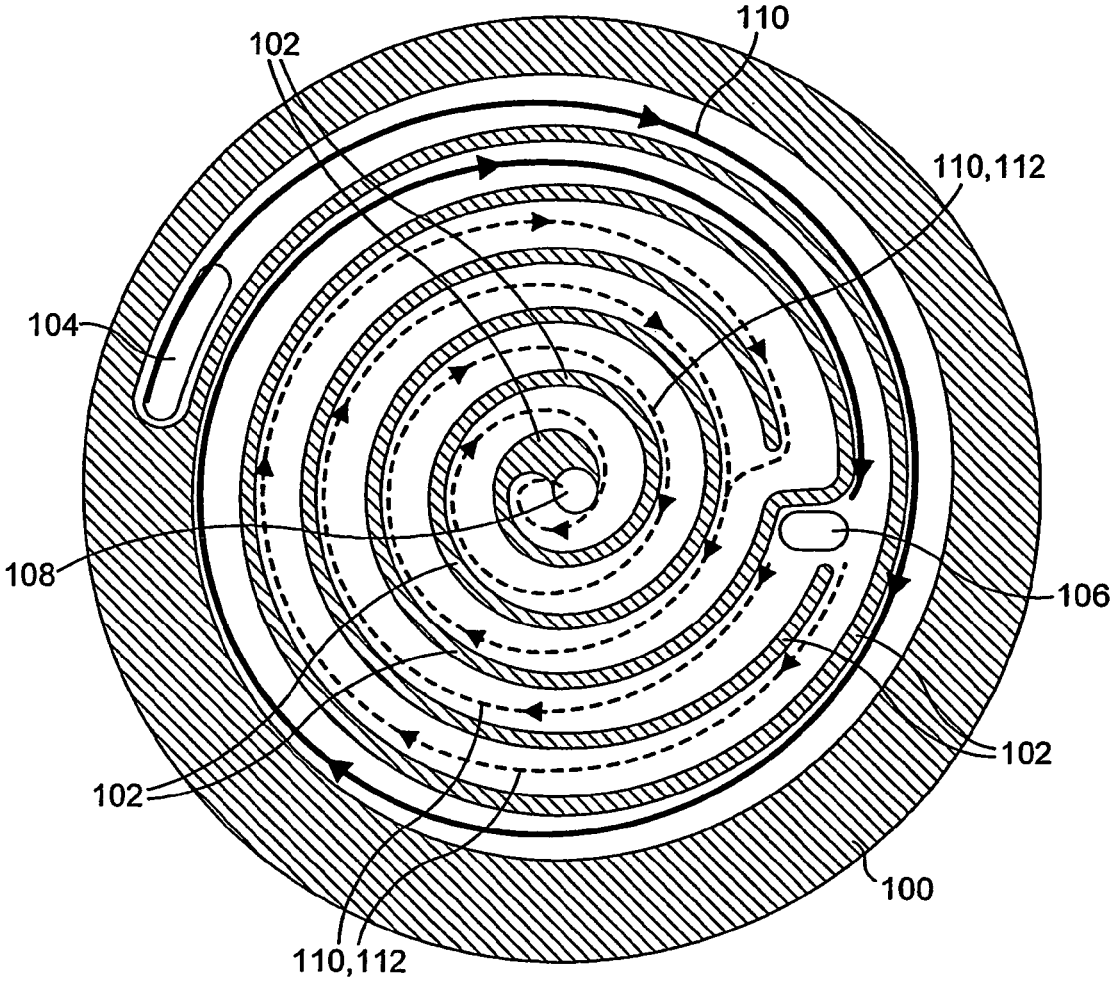
FIG. 7 shows a cross-section of another scroll wall arrangement, FIG. 7(*a*) showing the fixed scroll wall only and FIG. 7(*b*) showing both the fixed scroll wall and the orbiting scroll wall.
Figure 7B:
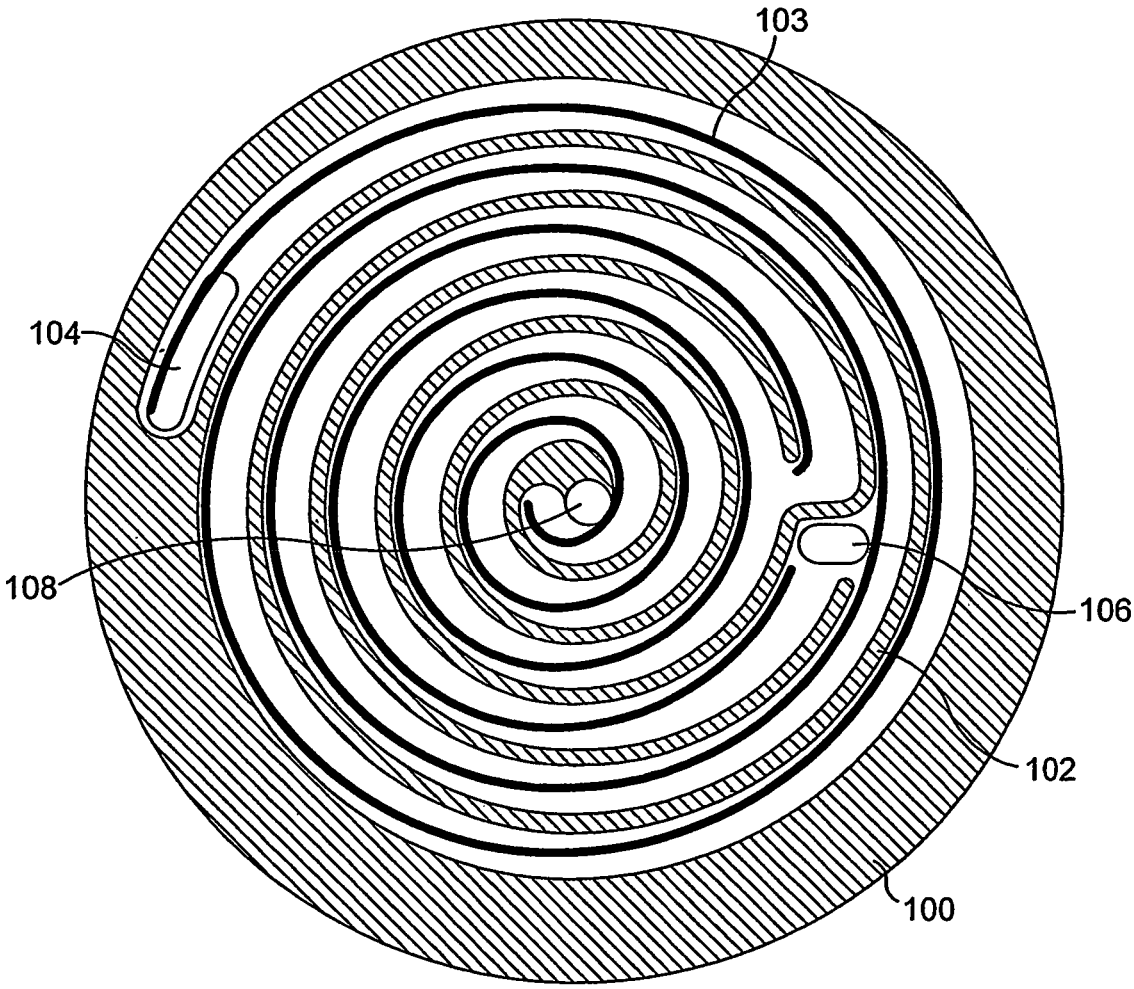

As shown in FIG. 4, it is possible to adopt a double start arrangement for the first inlet 48. FIG. 7(*a*) shows a fixed scroll 100 having fixed scroll walls 102, the orbiting scroll wall 103 being shown in FIG. 7(*b*). The arrangement comprises a first inlet 104, a second inlet 106 and an outlet 108. The arrangement is that of a single start in respect of the first inlet 104 and a double start in respect of the secondary inlet 106. A first flow path 110 extends through one-and-a-half wraps to the second inlet 106. At the second inlet 106, the first flow path 110 merges with two second flow paths 112 which extend from the second inlet 106 and over one wrap of the fixed scroll where they converge to a single merged flow path 110, 112 which extends to outlet 108. The provision of a double start at the second inlet 106 enables a greater quantity of gas to be pumped through the second inlet.

Figure 8A:
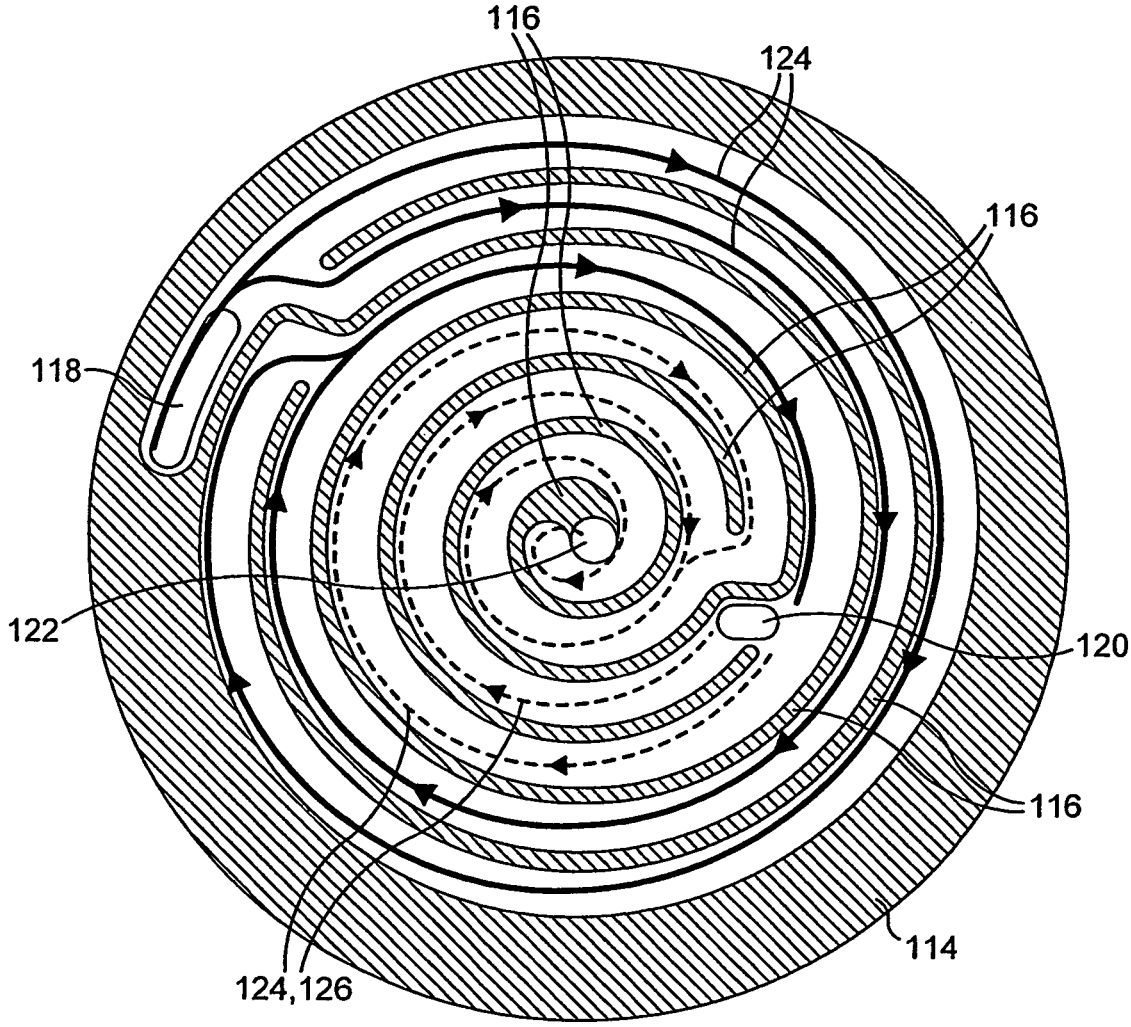
FIG. 8 shows a cross-section of yet another scroll wall arrangement, FIG. 8(*a*) showing the fixed scroll wall only and FIG. 8(*b*) showing both the fixed scroll wall and the orbiting scroll wall.
Figure 8B:
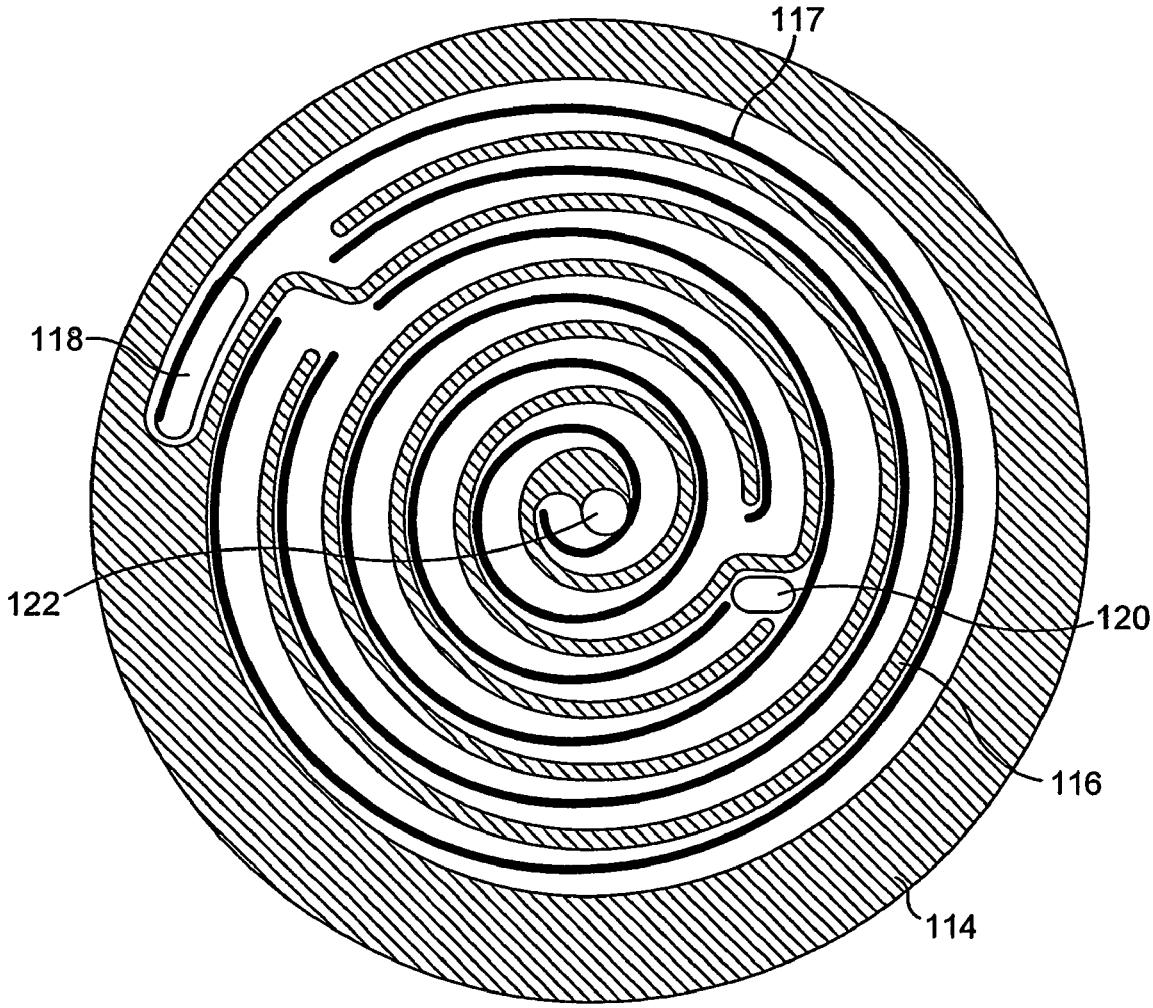

FIG. 8(*a*) shows a fixed scroll 114 having fixed scroll walls 116, the orbiting scroll wall 117 being shown in FIG. 8(*b*). The fixed scroll comprises a first inlet 118, a second inlet 120 and an outlet 122. The arrangement shows a double start for both the first inlet 118 and the second inlet 120. In this regard, two first flow paths 124 bifurcate from the first inlet 118 and extend over one wrap of the arrangement where they converge to a single first flow path 124. When the single first flow path meets the second inlet 120, it merges with the two second flow paths 126 which extend from the second inlet 120 over approximately one wrap of the arrangement where they converge to a single second flow path 126 and continue to the outlet 122. The advantage of this arrangement is that greater capacity of pumping can be achieved at both the first inlet 118 and the second inlet 120.

Figure 9:
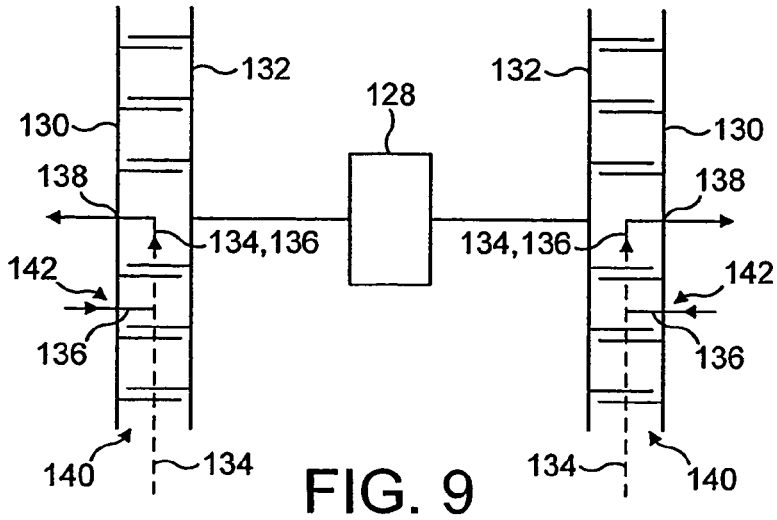
FIG. 9 is a schematic drawing showing two scroll wall arrangements.

The arrangements described above have been described with reference to the one sided scroll wall arrangement as shown in FIG. 1. As will be seen, a one-sided compressor comprises a single fixed scroll and a single orbiting scroll. FIG. 9 shows two one-sided scroll wall arrangements driven by a single motor 128. Each scroll wall arrangement comprises a fixed scroll 130 and an orbiting scroll 132, which together define first and second flow paths 134, 136 between an exhaust 138 and a first inlet 140 and a second inlet 142, respectively. Accordingly, the twin scroll wall arrangement comprises four flow paths for pumping at two to four different pressures.

Figure 10:
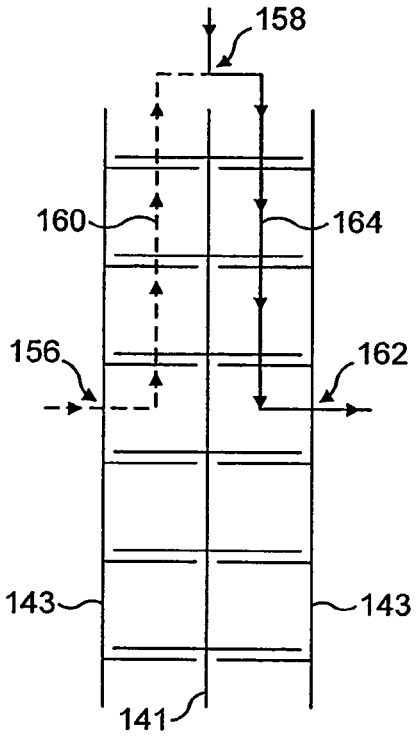
FIG. 10 is a schematic drawing showing a double-sided scroll wall arrangement
Figure 11:
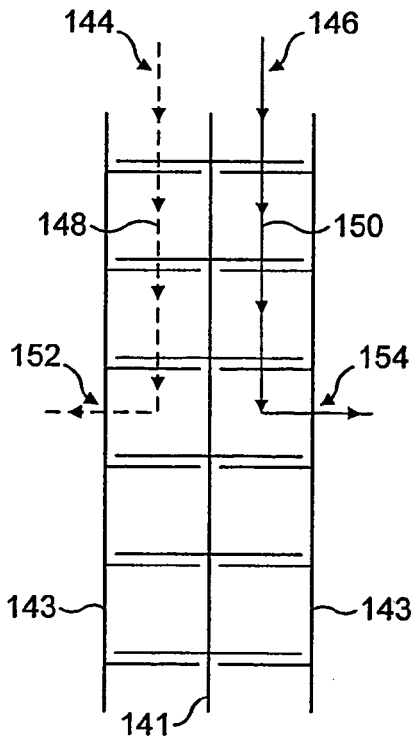
FIG. 11 is a schematic drawing showing another double-sided scroll wall arrangements.

A double sided scroll wall arrangement is known in which a single orbiting scroll 141 is associated with two fixed scrolls 143, one on each side thereof, as shown schematically in FIGS. 10 and 11. All of the embodiments and modifications described above can be incorporated into a double sided scroll compressor arrangement. Moreover, one scroll wall arrangement can be formed on one side of the fixed scroll and a different scroll wall arrangement can be formed on the other side of the fixed scroll. Alternatively, as shown in FIG. 11, the two sides of the double sided scroll arrangement are provided with a first inlet 144 and a second inlet 146 having respective flow paths 148, 150 extending towards respective outlets 152, 154 for providing pumping at different pressures. Further, the arrangement shown in FIG. 11 allows isolation of the gas species being pumped along the respective flow paths 152, 154. In a modification to the FIG. 11 arrangement, the sides of the scroll wall arrangement could be provided with respective second inlets as shown in FIG. 9.

As shown in FIG. 10, a double sided scroll wall arrangement comprises an inlet 156 at a radially central portion of a first side of the arrangement and an inlet 158 at a radially outer portion of the arrangement. A first flow path 160 extends radially outwardly from the first inlet 156 on the first side of the arrangement and radially inwardly to an exhaust 162 on a second side of the arrangement. A second flow path 164 extends from the second inlet 158 radially inwardly to the exhaust 162 on the second side of the arrangement. As shown, the first flow path merges with the second flow path at the second inlet 158. Alternatively, as described with reference to FIGS. 5 and 6, the second inlet 158 can be isolated from the first flow path by one or more wraps of the scroll wall arrangement so that the first flow path merges with the second flow path closer to the exhaust. The second inlet 158 functions as an intermediate inlet allowing pumping at a first pressure at the first inlet 156, and pumping at a second pressure at the second inlet 158.

It will be appreciated from the foregoing description that there are numerous modifications and arrangements possible which fall within the scope of the invention as defined in the accompanying claims.

We claim:

1. A scroll wall arrangement for a scroll compressor, comprising a fixed scroll wall and an orbiting scroll wall, which together define a plurality of flow paths having respective inlets for simultaneous pumping at different pressures, wherein the plurality of flow paths comprise a first flow path extending from a first inlet to an outlet and a second flow path extending from a second inlet to the outlet, and wherein the second inlet is isolated from the first flow path, and wherein the first and second flow paths converge to form a merged flow path.

2. The arrangement according to claim 1 wherein the second inlet is isolated from the first flow path by a portion of the second flow path.

3. The arrangement according to claim 1 wherein the second inlet is isolated from the first flow path by at least one wrap of the arrangement.

4. The arrangement as claimed in claim 1 wherein the pressure at the second inlet during pumping is higher than the pressure at the first inlet.

5. The arrangement as claimed in claim 1 wherein the pressure at the second inlet during pumping is lower than the pressure at the first inlet.

6. A scroll compressor comprising:

a scroll wall arrangement comprising:

a fixed scroll wall and an orbiting scroll wall arranged to form a first flow path and a second flow path, each flow path hang an inlet for pumping a gas at different pressures, wherein the inlet of the first flow path and the inlet of the second flow path extend to an outlet and wherein the inlet of the second flow path is isolated from the first flow path, and wherein the first and second flow paths converge to form a merged flow path.

7. The scroll compressor of claim 6 further comprising a second scroll wall arrangement.

8. The scroll compressor according to claim 7; wherein the fixed scroll walls of the scroll wall arrangements are formed as part of a fixed scroll common to both arrangements.

9. A differentially pumped system comprising:

a first chamber and a second chamber having a respective interconnection therebetween;

a turbomolecular pump having an inlet connected to the second chamber for pumping at relatively low pressures; and a scroll compressor comprising a fixed scroll wall and an orbiting scroll wall arranged to form a first flow path and a second flow path, each flow path having an inlet for pumping a gas at different pressures, wherein the inlet of the first flow path and the inlet of the second flow path extend to an outlet and the inlet of the second flow path is isolated from the first flow path and wherein the first and second flow paths converge to form a merged flow path, and wherein one inlet of the scroll compressor is connected to the first chamber for pumping at relatively high pressures and another inlet of the scroll compressor is connected to the exhaust of the turbomolecular pump for backing the same.

10. The system according to claim 9 wherein the inlet of the second flow path is connected to the second chamber for pumping at relatively high pressures and the inlet of the first flow path is connected to the exhaust of the turbomolecular pump for backing the same.

11. The system according to claim 9 wherein the inlet of the first flow path is connected to the second chamber for pumping at relatively high pressures and the inlet of the second flow path is connected to the exhaust of the turbomolecular pump for backing the same.

12. The system according to claim 9 wherein the turbomolecular pump is a split flow pump and comprises an interstage inlet connected to the first chamber for pumping the same.

13. The system according to claim 9 wherein the inlet of the first flow path is connected to the first chamber and the exhaust of the turbomolecular pump.

14. A scroll wall arrangement for a scroll compressor comprising:

a fixed scroll wall and an orbiting scroll wall, which together define a plurality of flow paths having respective inlets for simultaneous pumping at different pressures, wherein the plurality of flow paths comprise a first flow path extending from a first inlet to an outlet and a second flow path extending from a second inlet to the outlet and wherein the second inlet is isolated from the first flow path by one revolution of the fixed scroll wall and the second flow path extends from the second inlet through 360° where it merges with the first flow path.

* * * * *